US011988464B2

(12) United States Patent
Zhou et al.

(10) Patent No.: US 11,988,464 B2
(45) Date of Patent: May 21, 2024

(54) HEAT EXCHANGER, METHOD FOR MAKING HEAT EXCHANGER, AND HEAT EXCHANGE SYSTEM

(71) Applicant: HANGZHOU SANHUA RESEARCH INSTITUTE CO., LTD., Hangzhou (CN)

(72) Inventors: Jing Zhou, Hangzhou (CN); Hai Huang, Singapore (SG); Ningjie Huang, East Amherst, NY (US)

(73) Assignee: ZHEJIANG SANHUA INTELLIGENT CONTROLS CO., LTD., Shaoxing (CN)

( * ) Notice: Subject to any disclaimer, the term of this patent is extended or adjusted under 35 U.S.C. 154(b) by 608 days.

(21) Appl. No.: 17/135,858

(22) Filed: Dec. 28, 2020

(65) Prior Publication Data

US 2021/0116189 A1 Apr. 22, 2021

Related U.S. Application Data

(63) Continuation of application No. PCT/CN2020/105112, filed on Jul. 28, 2020.

(30) Foreign Application Priority Data

Aug. 1, 2019 (CN) ..... 201910709088.7

(51) Int. Cl.

| | |
|---|---|
| ***F28F 19/06*** | (2006.01) |
| ***F28D 1/053*** | (2006.01) |
| ***F28F 1/12*** | (2006.01) |

(52) U.S. Cl.

CPC ..... *F28F 19/06* (2013.01); *F28D 1/05383* (2013.01); *F28F 1/126* (2013.01); *F28F 2245/02* (2013.01)

(58) Field of Classification Search

CPC ..... F28F 19/06; F28F 1/126; F28F 2245/02; F28D 1/05383

See application file for complete search history.

(56) References Cited

U.S. PATENT DOCUMENTS

2023/0235970 A1* 7/2023 Ozaki ..... F28F 19/02 165/104.17

FOREIGN PATENT DOCUMENTS

| | | |
|---|---|---|
| CN | 1226918 A | 8/1999 |
| CN | 1768245 A | 5/2006 |
| CN | 201281442 Y | 7/2009 |

(Continued)

*Primary Examiner* — Devon Russell

(74) *Attorney, Agent, or Firm* — Cheng-Ju Chiang

(57) ABSTRACT

A heat exchanger disclosed in the present disclosure includes a first collecting pipe, a second collecting pipe, a number of heat exchange tubes, at least one fin and a hygroscopic colloid. The heat exchange tube has a pipe wall and a refrigerant flow channel for a refrigerant to circulate. The heat exchange tube has a first end and a second end. The refrigerant flow channel extends from the first end to the second end along an extension direction of the heat exchange tube and extends through the heat exchange tube. The hygroscopic colloid is adhered to at least part of an outer surface of the heat exchange tube and/or the fin. The present disclosure also discloses a heat exchange system having the heat exchanger and a method for making the heat exchanger. The hygroscopic colloidal material of the present disclosure is friendly to metal surfaces.

11 Claims, 7 Drawing Sheets

(56) References Cited

FOREIGN PATENT DOCUMENTS

| | | | | | |
|---|---|---|---|---|---|
| CN | 101839591 | A | | 9/2010 | |
| CN | 201575646 | U | | 9/2010 | |
| CN | 102192620 | A | | 9/2011 | |
| CN | 102226665 | A | | 10/2011 | |
| CN | 102414532 | A | | 4/2012 | |
| CN | 202494207 | U | | 10/2012 | |
| CN | 202511528 | U | | 10/2012 | |
| CN | 103712376 | A | | 4/2014 | |
| CN | 105705900 | A | | 6/2016 | |
| CN | 106403641 | A | | 2/2017 | |
| CN | 106847673 | A | | 6/2017 | |
| CN | 107385420 | A | | 11/2017 | |
| CN | 107782194 | A | | 3/2018 | |
| CN | 108036658 | A | | 5/2018 | |
| CN | 108885071 | A | | 11/2018 | |
| CN | 109297105 | A | | 2/2019 | |
| EP | 2172729 | A1 | | 4/2010 | |
| IN | 109297106 | A | | 2/2019 | |
| JP | H10-286460 | A | | 10/1998 | |
| JP | 2000-234894 | A | | 8/2000 | |
| JP | 2006-138567 | A | | 6/2006 | |
| JP | 2006138567 | A | * | 6/2006 | ..... F28F 13/18 |
| JP | 3823458 | B2 | * | 9/2006 | |
| JP | 2017-150756 | A | | 8/2017 | |
| JP | 2019-95089 | A | | 6/2019 | |
| WO | 2005/095880 | A1 | | 10/2005 | |
| WO | WO-2006077672 | A1 | * | 7/2006 | ..... B01D 53/26 |
| WO | 2006/082905 | A1 | | 8/2006 | |
| WO | WO-2006082905 | A1 | * | 8/2006 | ..... C09D 5/086 |
| WO | 2010/092875 | A1 | | 8/2010 | |
| WO | WO-2010092875 | A1 | * | 8/2010 | ..... A01N 25/10 |
| WO | 2018/047971 | A1 | | 3/2018 | |
| WO | WO-2018047971 | A1 | * | 3/2018 | ..... B23K 1/00 |
| WO | PCT/CN2020/105112 | | | 7/2020 | |

* cited by examiner

HEAT EXCHANGER, METHOD FOR MAKING HEAT EXCHANGER, AND HEAT EXCHANGE SYSTEM

CROSS-REFERENCE TO RELATED APPLICATION

This application is a continuation of National Phase conversion of International (PCT) Patent Application No. PCT/CN2020/105112, filed on Jul. 28, 2020, which further claims priority of a Chinese Patent Application No. 201910709088.7, filed on Aug. 1, 2019 and titled "HEAT EXCHANGER, METHOD FOR MAKING HEAT EXCHANGER, AND HEAT EXCHANGE SYSTEM", the entire content of which is incorporated herein by reference.

TECHNICAL FIELD

This application relates to a field of heat exchange, and specifically to a heat exchanger and a method thereof, and a heat exchange system having the heat exchanger.

BACKGROUND

In related technologies, due to low surface temperature of heat exchangers in the operation of heat exchange systems, when the temperature is lower than the dew point temperature, condensed water may be generated on a surface, and even frost may form, thereby affecting the heat exchange efficiency of the heat exchangers. Therefore, related heat exchangers need dehumidification treatment. In related technologies, the surface of the heat exchanger is treated with a lithium salt desiccant or a silica gel hygroscopic material. However, the lithium salt desiccant is not friendly to metal surfaces, and the silicone hygroscopic material is not sticky. Therefore, it is necessary to add an additional adhesive to make it adhere to the surface of the heat exchanger. In summary, the heat exchanger in the related technologies needs to be improved.

SUMMARY

According to one aspect of the present disclosure, a heat exchanger is provided. The heat exchanger comprises a first collecting pipe, a second collecting pipe, a plurality of heat exchange tubes, at least one fin and a hygroscopic colloid. The tube is respectively connected with the first collecting pipe and the second collecting pipe, the heat exchange tube comprises a pipe wall and a refrigerant flow channel for a refrigerant to circulate, the heat exchange tube comprises a first end and a second end extends along an extension direction thereof, the refrigerant flow channel extends from the first end to the second end along the extension direction of the heat exchange tube and extends through the heat exchange tube, and the refrigerant flow channel of the heat exchange tube communicates with an inner cavity of the first collecting pipe and an inner cavity of the second collecting pipe. The fin is at least partially arranged between two adjacent heat exchange tubes. The hygroscopic colloid is adhered to at least part of an outer surface of the heat exchange tube and/or at least part of an outer surface of the fin.

According to another aspect of the present disclosure, a heat exchange system is provided. The heat exchange system comprises a compressor, at least one first heat exchanger, a throttling device and at least one second heat exchanger. At least partial surface of the first heat exchanger and/or the second heat exchanger is covered with a hygroscopic colloid. When a refrigerant flows in the heat exchange system, the refrigerant flows into the first heat exchanger through the compressor, flows into the throttling device after heat exchange occurs in the first heat exchanger, then flows into the second heat exchanger and flows into the compressor again after heat exchange occurs in the second heat exchanger.

According to another aspect of the present disclosure, a method for making a heat exchanger is provided. The method for making a heat exchanger includes steps of providing a collecting pipe, a plurality of heat exchange tubes and at least one fin, inserting first ends and second ends of the plurality of heat exchange tubes into corresponding openings of the collecting pipe respectively, assembling the fins between two adjacent heat exchange tubes, and performing a welding treatment after the assembly is completed; and providing a hygroscopic colloid, covering the hygroscopic colloid on the heat exchanger, and then performing a low temperature curing treatment; wherein a covering method is one or more of spraying, brushing and dipping, and a temperature of the curing treatment is 40° C. to 70° C.

At least partial surface of the heat exchanger of the present disclosure is covered with a hygroscopic colloid material. The hygroscopic colloidal material can be directly covered on a metal surface due to its adhesiveness to the metal surface, and the hygroscopic colloidal material is friendly to metal surfaces.

DETAILED DESCRIPTION

Figure 1:
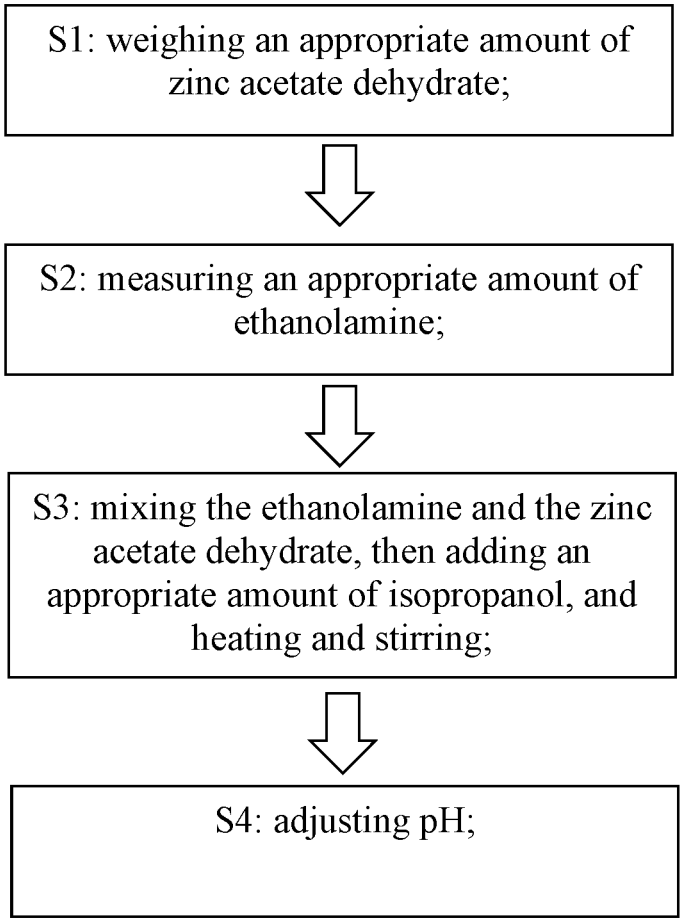
FIG. 1 is a schematic diagram of a preparation process of a zinc oxide gel according to an embodiment of the present disclosure.

Here, exemplary embodiments will be described in detail, and examples thereof are shown in the drawings. When the following description refers to the drawings, unless otherwise indicated, same numbers in different drawings indicate the same or similar elements. The embodiments described in the following exemplary embodiments do not represent all implementation embodiments consistent with the present disclosure. On the contrary, they are only examples of devices and methods consistent with some aspects of the present disclosure as described in detail in the accompanying claims.

The terms used in the present disclosure are only for the purpose of describing specific embodiments and are not intended to limit the present disclosure. In the description of present disclosure, it should be understood that the terms "center", "longitudinal", "transverse", "length", "width", "thickness", "upper", "lower", "front", ""back", "left", "right", "vertical", "horizontal", "top", "bottom", "inner", "outer", "clockwise", "counterclockwise" and other directions or positional relationships are based on the orientation or positional relationships shown in the drawings. They are only for the convenience of describing the present disclosure and simplifying the description, and do not indicate or imply that the device or element referred to must have a specific orientation, be constructed and operated in a specific orientation. Therefore, they cannot be understood as a restriction of the present disclosure. In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of present disclosure, "a plurality of" means two or more than two, unless otherwise specifically defined.

In the description of present disclosure, it should be noted that, unless otherwise clearly defined and limited, the terms "installation", "connection" and "communication" should be interpreted broadly. For example, it can be a fixed connection, a detachable connection or an integral connection. It can be a mechanical connection or an electrical connection. It can be a direct connection or an indirect connection through an intermediary. It can be a communication between two elements or an interaction between two elements. For those of ordinary skill in the art, the specific meanings of the above terms in present disclosure can be understood according to specific circumstances.

In present disclosure, unless expressly stipulated and defined otherwise, a first feature located "above" or "under" a second feature may include the first feature and the second feature are in direct contact, or may include the first feature and the second feature are not in direct contact but through other features between them. Moreover, the first feature located "above", "on top of" and "on" the second feature includes the first feature is located directly above and obliquely above the second feature, or it simply means that the level of the first feature is higher than the second feature. The first feature located "below", "at bottom of" and "under" the second feature includes the first feature is located directly below and obliquely below the second feature, or it simply means that the level of the first feature is lower than the second feature. The exemplary embodiments of the present disclosure will be described in detail below with reference to the drawings. In the case of no conflict, the following embodiments and features in the embodiments can be mutually supplemented or combined.

The terms used in present disclosure are only for the purpose of describing specific embodiments and are not intended to limit the disclosure. The singular forms of "a", "said" and "the" used in present disclosure and the appended claims are also intended to include plural forms, unless the context clearly indicates other meanings.

The exemplary embodiments of the present disclosure will be described in detail below with reference to the drawings. In the case of no conflict, the following embodiments and features in the implementation can be combined with each other.

Related heat exchangers, especially in air conditioning systems, when used as an evaporator during system operation, due to their low surface temperature, condensed water may be generated on the outer surface of the heat exchanger, which may even further cause frosting. However, the generation of condensed water or frost will cause the heat exchange efficiency of the heat exchanger to decrease, thereby making it difficult for the heat exchanger to exert better heat exchange performance. Hence, it is necessary to avoid condensed water or frost on the outer surface of the heat exchanger. One way is to bond hygroscopic or desiccant materials on the surface of the heat exchanger, such as silica gel and its physical or chemical compound desiccant, so as to reduce the impact of the wet load on the air conditioning systems. However since silica gel itself is not sticky, it is necessary to spray a layer of adhesive on the surface of the heat exchanger first. The adhesive can bond silica gel or its physical or chemical composite desiccant material to the metal surface. Since silica gel has a porous structure, the use of a binder will cause the micropores of silica gel to be blocked, thereby reducing moisture absorption. Moreover, the use of adhesives may also be detrimental to the heat exchange of the heat exchanger. In addition, the moisture absorption of silica gel itself (about 0.35 g/g) is relatively small. Although halogen salts and silica gel can be used in heat exchangers, the moisture absorption performance is greatly improved, but after the halogen salts absorb moisture, electrochemical corrosion will occur on the metal surface, which shortens the life of the heat exchanger.

An embodiment of the present disclosure provides a heat exchanger which is simple to manufacture. The outer surface of the heat exchanger is covered with a hygroscopic colloid. Due to the viscosity of the hygroscopic colloid itself, the fluidity of the gel after drying is not strong. Therefore, no additional binder is required. At room temperature, a pH value of the hygroscopic colloid is between 6 to 8, and it can be directly coated on a metal surface, such as a surface of aluminum or copper, and it is friendly to the metal surface. The hygroscopic colloidal material has a large moisture absorption capacity, which is better than silica gel and its composite materials. Inventors believe that the solute properties of the hygroscopic colloidal material are stable. For example, the solute of the zinc oxide gel is the metal oxide zinc oxide, and the solute material is more friendly to metals, especially copper or aluminum. At the same time, metal oxides such as zinc oxide have good thermal conductivity, and their covering on the surface of the heat exchanger can also relatively reduce the influence of the adhesive on the heat exchange performance of the heat exchanger.

The application of zinc oxide gel material to heat exchanger dehumidification effectively solves the problems of low moisture absorption of existing materials and the need for binders. The embodiment of the present disclosure provides a heat exchange system including the heat exchanger. The heat exchanger can be used as an evaporator in a heat pump air conditioning system. It is easy to understand that, in addition to being used as a heat exchanger in a heat pump system, the heat exchanger can also be used in other occasions where heat is exchanged with air. There is no restriction here.

The hygroscopic colloid covered by the heat exchanger of this embodiment includes but is not limited to zinc oxide gel. This embodiment takes zinc oxide material as an example. Of course, according to the rules of the periodic table and the periodic law of the elements, for example, the sol material formed by the same group of elements or elements near the diagonal also has similar properties, and is also within the protection scope of the present disclosure.

FIG. 1 shows a preparation flow chart of a zinc oxide gel provided in an embodiment of the present disclosure. The embodiment of the present disclosure provides a method for making zinc oxide gel, which includes the following steps:

S1: weighing 21.9 g of zinc acetate dihydrate, of which the molecular formula is $Zn(CH_3COO)_2 \cdot 2H_2O$, used as a main raw material for the reaction in order to provide the source of zinc;

S2: measuring 6 ml ethanolamine, of which the molecular formula is $H_2N(CH_2)_2OH$, used to stabilize zinc acetate dihydrate from decomposition in the air;

S3: mixing the zinc acetate dihydrate in the step S1 with the ethanolamine in the step S2 in a mixture; then, adding 200 ml of isopropanol to the mixture, of which the molecular formula is $(CH_3)_2CHOH$, used to dissolve the zinc acetate dehydrate; and reacting with the zinc acetate dihydrate under heating at 70° C.;

S4: after the solution in the step S3 gradually becomes transparent, adding sodium bicarbonate to adjust the pH to 6 to 8.

A reaction equation of the above reaction is:

$$4Zn(CH_3COO)_2 \cdot 2H_2O \rightarrow Zn_4O(CH_3COO)_6 + 7H_2O + CH_3COOH$$

$$CH_3COOH + NaHCO_3 \rightarrow CH_3COONa + H_2O + CO_2\uparrow$$

It should be noted that in the step S4, to adjust the pH value, some salts that are weakly alkaline after hydrolysis, such as sodium bicarbonate, or weak bases, such as ammonia can be selected. In this way, it is convenient to control the pH value to a required pH value. Among them, the heating temperature in the step S3 can be 40° C. to 100° C., for example, it can be heated at 70° C. The heating method can be water bath heating or direct heating. In this way, it is beneficial to accelerate the dissolution of zinc acetate dihydrate. The stirring speed can be selected from 200 to 600 r/min. In this embodiment, the stirring speed is 300 r/min.

Figure 2:
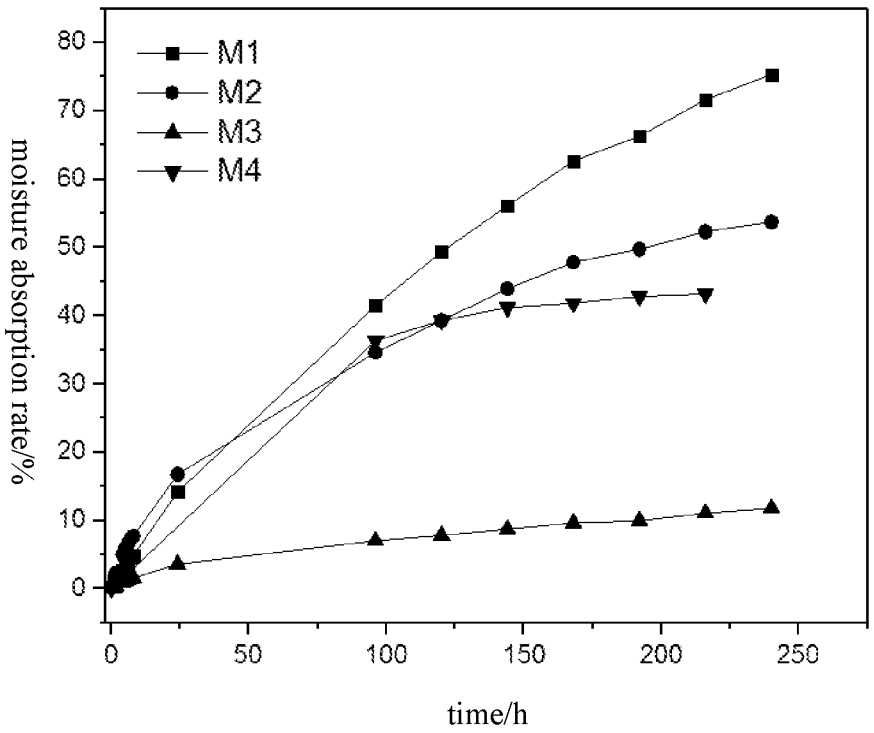
FIG. 2 is a schematic diagram of a comparison of moisture absorption performance of the zinc oxide gel according to the embodiment of the present disclosure in FIG. 1 and other three moisture absorption materials.

FIG. 2 shows a schematic diagram of a comparison of the moisture absorption properties of zinc oxide gel and other three materials. Among them, M1 is zinc oxide gel material, M2 and M3 are respectively mesoporous silica gel (pore size is about 4 nm to 7 nm) and macroporous silica gel (pore size is about 7 nm to 10 nm), and M4 is a silica gel/glycerol composite material. The moisture absorption is defined as the percentage of the water absorbed by a certain mass of the material to the same mass without water absorption. As shown in the figure, the test was performed at 20° C. and 90% RH. Among them, the moisture absorption performance of M1 zinc oxide gel is better than M2 and M3, and also better than M4 silica gel/glycerol composite.

After 100 hours of absorbing moisture, the moisture absorption of M1 zinc oxide gel reaches 42%, and the moisture absorption of M2 is 34%. The moisture absorption of M4 silica gel/glycerol composite is 36%, which is 2% more than M2. This is mainly because after the addition of glycerol, the saturated vapor pressure of silica gel is reduced, which can absorb water faster. After 100 hours, the moisture absorption of M3 reaches 8%, and the moisture absorption is the smallest. Because of its large pore size, it will also release moisture while absorbing moisture.

After 240 hours, the moisture absorption of M1 is the largest, reaching 75%. It is followed by M2 of which the moisture absorption is 54%. The moisture absorption of M3 is 42%. Because of the limited size of silica gel pores, after glycerol is adsorbed inside, the volume that can be used for water storage becomes smaller. The last is M4 of which the moisture absorption is 12%. The inventors believe that the above result is mainly because the zinc oxide gel contains a large amount of hydrophilic groups.

Figure 3:
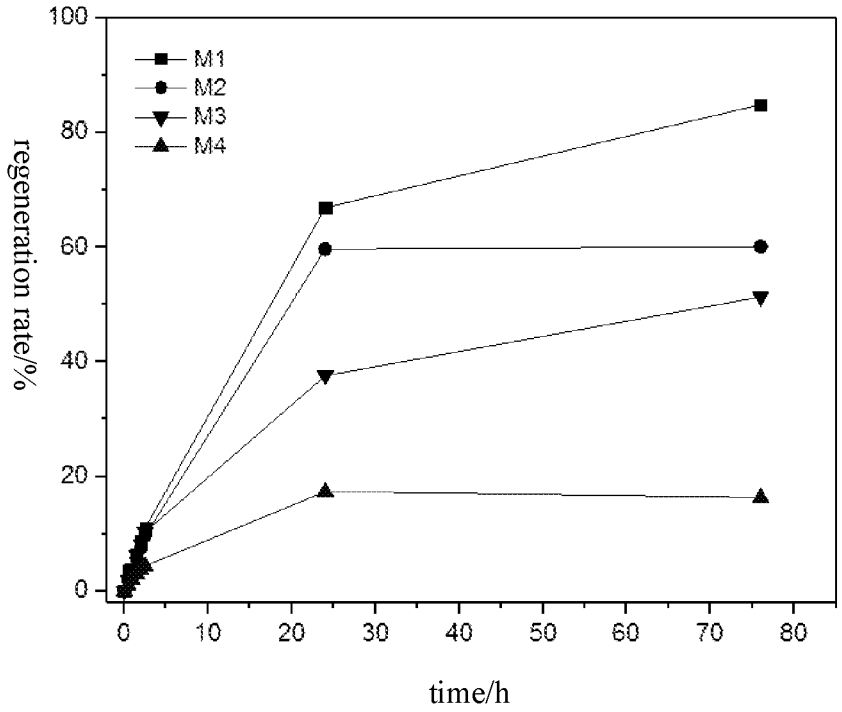
FIG. 3 is a schematic diagram of a desorption performance comparison between the zinc oxide gel according to the embodiment of the present disclosure in FIG. 1 and other three hygroscopic materials.

FIG. 3 shows a schematic diagram of the desorption performance comparison among the zinc oxide gel and other three materials. Among them, M1 is a zinc oxide gel material, M2 and M3 are mesoporous silica gel (pore size is about 4 nm to 7 nm) and macroporous silica gel (pore size is about 7 nm to 10 nm), and M4 is a silica gel/glycerol composite material.

A regeneration rate is defined as the percentage of water desorbed by a certain mass of the material to the original saturated water. As shown in FIG. 3, at a temperature of 70° C., M1 has the fastest regeneration speed. After 24 hours, the regeneration rate is 67%. Followed by M2, its regeneration rate is 60%. The main reason is that high temperature accelerates water decomposition and absorption. At the same time, due to the large moisture absorption of M1 and M2, the regeneration rate is high. M3 has a regeneration rate of 39% at 24 hours, while the regeneration rate of M4 is only 18%. The regeneration rate determines the desorption performance of the hygroscopic material. When the hygroscopic material is covered on the surface of the heat exchanger, a good desorption performance is beneficial to the regeneration of the hygroscopic material.

Figure 4:
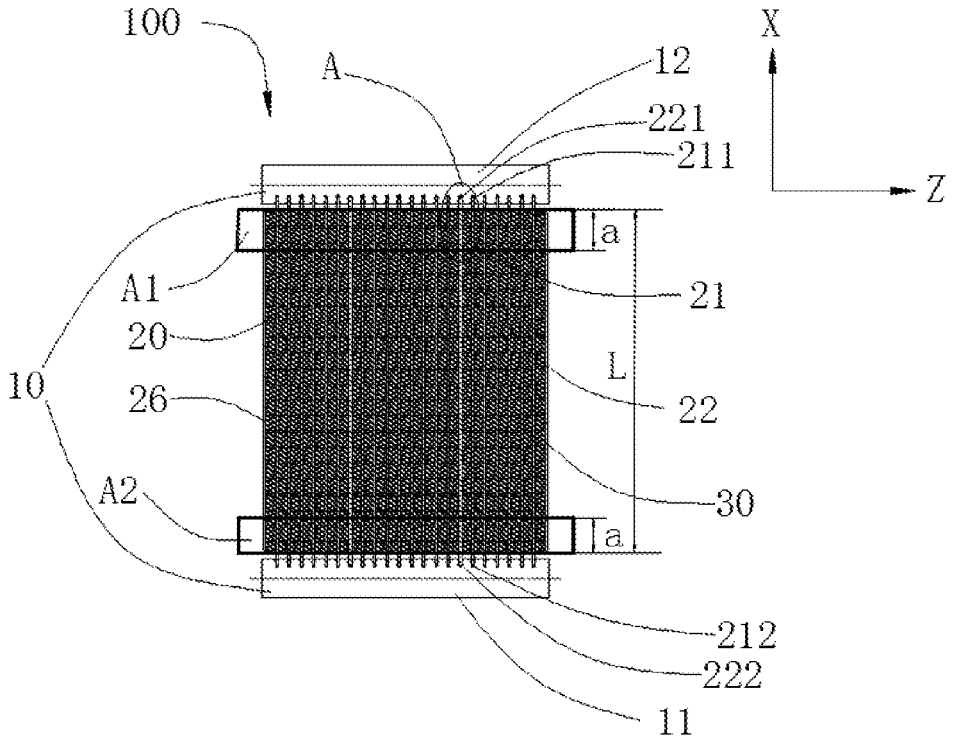
FIG. 4 is a schematic structural view of a heat exchanger covered with a hygroscopic colloid on its surface according to an embodiment of the present disclosure.
Figure 5:
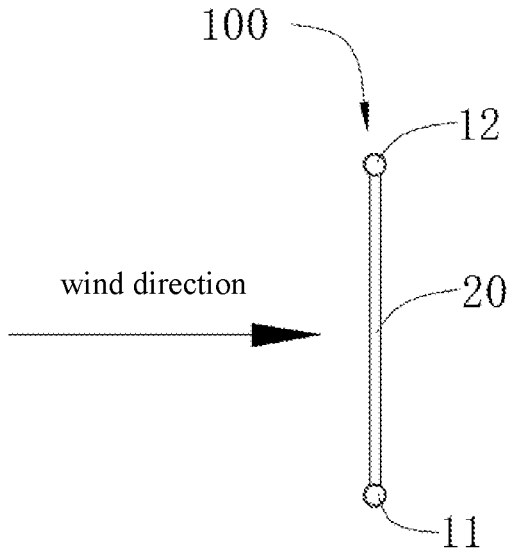
FIG. 5 is a schematic structural view of the heat exchanger of the embodiment in FIG. 4 from another angle.

As shown in FIGS. 4 and 5, the specific implementation of the heat exchanger of the present disclosure will be described in conjunction with other figures when necessary.

The heat exchanger 100 of an embodiment of the present disclosure may include a collecting pipe 10, a plurality of heat exchange tubes 20 and at least one fin 30. The collecting pipe 10 has an inner cavity (not shown in the figure) for a refrigerant to circulate, and the shape of the collecting pipe 10 is a circular pipe. The number of the collecting pipe 10 is two, namely a first collecting pipe 11 and a second collecting pipe 12. The first collecting pipe 11 and the second collecting pipe 12 are arranged substantially in parallel. It should be noted that, in some embodiments, the heat exchanger may only include one collecting pipe, as long as it meets the design or heat exchange requirements. Optionally, in some other embodiments, the heat exchanger may also include a plurality of the collecting pipes. A communication structure can be arranged between adjacent collecting pipes and flow paths can be set as needed, which is not limited here. The heat exchanger in this embodiment includes two such collecting pipes. In this embodiment, it is noted that when the heat exchanger 100 and air generally undergo heat exchange only one time, it is often referred to as a single-layer heat exchanger in the industry. In some other embodiments, the heat exchanger may also have no fin 30, as long as it meets the heat exchange requirements, which is not limited here.

Of course, in some other embodiments, the collecting pipe 10 may also be a D-shaped or square pipe. The specific shape of the collecting pipe 10 is not limited, as long as its burst pressure meets the needs of the system. The relative position of the collecting pipe 10 is also not limited, as long as it meets the actual installation requirements. The number of the collecting pipe 10 can also be only one, as long as it meets the heat exchange requirement, which is not limited here. The collecting pipe 10 in the embodiment of the present disclosure is a round pipe as an example.

There are a plurality of the heat exchange tubes 20 which are arranged along an axial direction of the collecting pipe 10 and are arranged substantially in parallel. Each of the plurality of heat exchange tubes 20 has a first end 221 and a second end 222. As shown in FIG. 4, the heat exchange tube 20 includes a first heat exchange tube 21 and a second heat exchange tube 22 which are arranged side by side. A direction in which the first end 221 of the heat exchange tube 20 extends to the second end 222 is a length direction of the heat exchange tube. It is noted that the heat exchange tube may be a bent heat exchange tube. The length direction is not limited to a linear direction. In other words, an extension direction of the heat exchange tube may be the linear direction or a non-linear direction, which is not limited here. The first end 211 of the first heat exchange tube 21 is connected to the first collecting pipe 11. The second end 212 of the first heat exchange tube 21 is connected to the second collecting pipe 12. Similarly, the first end 221 of the second heat exchange tube 22 is connected to the first collecting pipe 11. The second end 222 of the second heat exchange tube 22 is connected to the second collecting pipe 12. The first heat exchange tube 21 and the second heat exchange tube 22 are arranged substantially in parallel. The heat exchange tube 20 has an inner cavity (not shown in the figure) for the refrigerant to circulate. Such connection makes the inner cavity of the heat exchange tube 20 communicate with the inner cavity of the collecting pipe 10 so as to form a refrigerant flow channel of the heat exchanger 100 (not shown in the figure). The refrigerant can circulate in the heat exchange channel, and the heat exchange can be achieved through the heat exchanger 100.

When the heat exchanger 100 is used as an evaporator in a heat exchange system, its outer surface usually has a lower temperature. The moisture in the air is easy to condense on the surface of the evaporator, forming a water film, or further frost, which affects the heat exchange performance of the evaporator. At least partial surface of the heat exchanger is covered with the hygroscopic colloid 40. The hygroscopic colloid 40 can absorb moisture or moisture on the surface of the evaporator through its unique hygroscopic characteristics, so as to delay or avoid the formation of water film on the surface of the evaporator, and then to delay or avoid frost on the evaporator surface. Finally, the heat exchange performance of the evaporator is maintained to a certain extent, or the rapid decline of the heat exchange performance of the evaporator is delayed. It is worth noting that the surface of the heat exchanger in the related art is covered with functional materials, such as corrosion-resistant materials. Specifically, it is covered on the outer surface of the entire heat exchanger. Since the functional materials will affect the heat transfer effect, the heat transfer performance of the entire heat exchanger will decrease. However, the hygroscopic colloid 40 used in the present disclosure, due to the viscosity of the hygroscopic colloid itself, it does not have strong fluidity in a gel state after drying, so no additional binder is required. This has little effect on the heat exchange performance of the heat exchanger. The hygroscopic colloid 40 can be directly coated on a metal surface, such as a surface of aluminum or copper. The hygroscopic colloid 40 is friendly to the metal surface. The hygroscopic colloid 40 material has a large moisture absorption capacity, which is better than silica gel and its composite materials. The inventors believe that the solute properties of hygroscopic colloidal materials are stable. For example, the solute of zinc oxide gel is metal oxide zinc oxide. The solute materials are relatively friendly to metals. At the same time, metal oxides, such as zinc oxide, have good thermal conductivity. The covering on the surface of the heat exchanger can also relatively reduce the influence of the heat exchange performance of the heat exchanger. In addition, the hygroscopic colloid 40 may be covered on part of the outer surface of the heat exchanger, especially part of the fin. In other words, the hygroscopic colloid is covered on the frost-prone portions of the heat exchanger, and the hygroscopicity of the hygroscopic colloid 40 is used to delay the generation of water film or frost to a certain extent. In this way, while ensuring the heat exchange efficiency of the heat exchanger, it can also delay the attenuation of the heat exchange efficiency to a certain extent. The specific overlay structure and overlay method will be described in detail in the following description.

It should be noted that the heat exchange tube 20, also known as a flat tube in the industry, has an inner cavity inside for the refrigerant to circulate. As shown in FIG. 8, the inner cavity of the heat exchange tube 20 (not shown in the figure) is usually separated by ribs 231 into a plurality of refrigerant flow channels 232. With this arrangement, not only the heat exchange area of the heat exchange tube 20 is increased so that the heat exchange efficiency is improved, but also the inner surface of the heat exchange tube 20 can be provided with tiny protrusions 233 which can form a capillary effect to enhance heat exchange. Shapes of the protrusions 233 can be sawtooth, wave, triangle, etc., (not shown in the figure), and the shapes can be set as required. Adjacent channels 232 are isolated from each other. A plurality of channels 232 are arranged in a row and collectively affect a width of the heat exchange tube 20. The heat exchange tube 20 is flat as a whole, and its length is greater than its width, and its width is greater than its thickness. The heat exchange tube mentioned here is not limited to this type, and may be of other forms. For example, adjacent channels may not be completely isolated. For another example, all channels can be arranged in two rows, as long as the width is still greater than the thickness. As shown in FIGS. 4 to 10, the heat exchanger 100 of the embodiment of the present disclosure further includes the fins 30.

Figure 6:
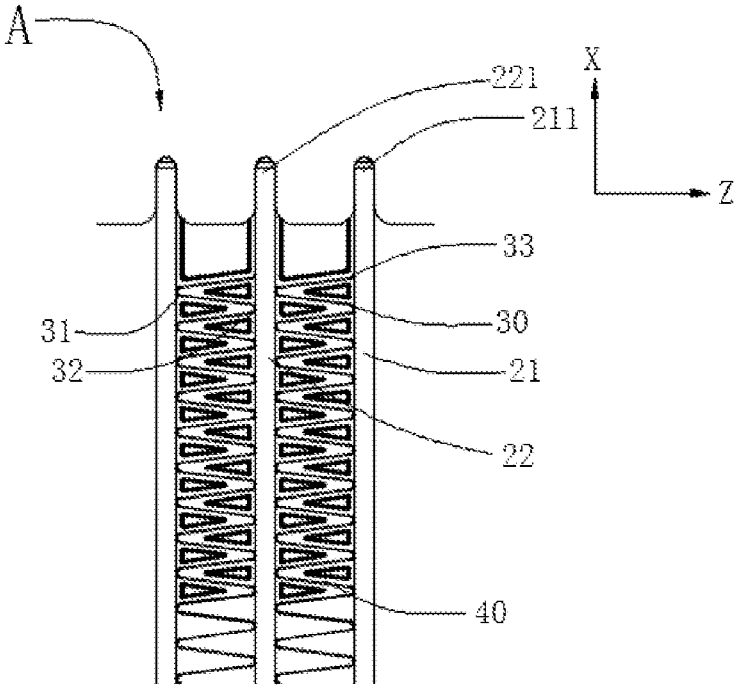
FIG. 6 is a partial enlarged schematic view of area A of the heat exchanger in the embodiment of the present disclosure in FIG. 4.
Figure 7:
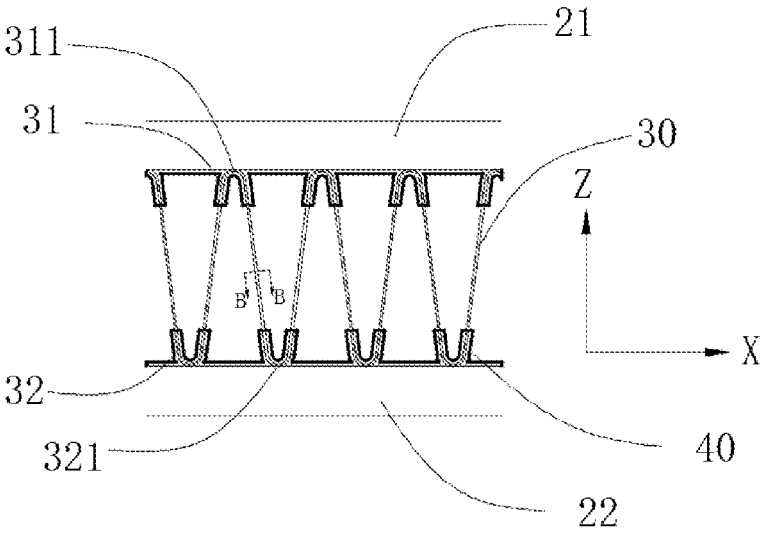
FIG. 7 is a schematic structural view of a partial coating of a fin in the heat exchanger according to an embodiment of the present disclosure.
Figure 8:
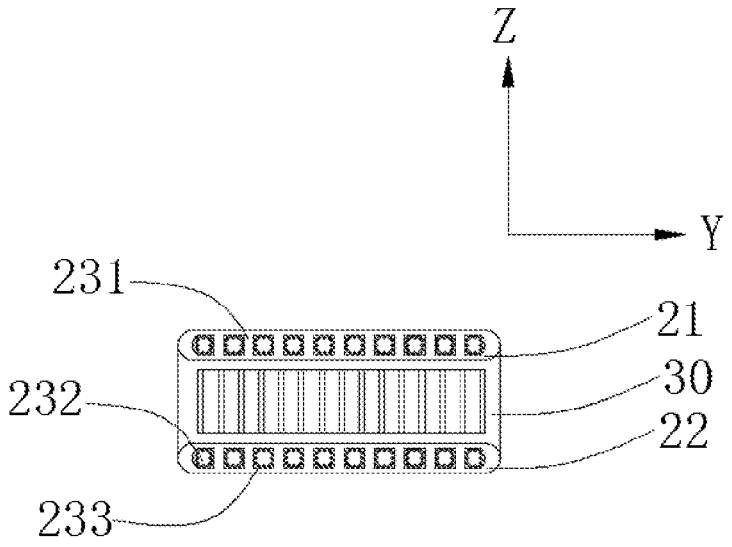
FIG. 8 is a schematic structural view of a heat exchange tube and the fins of the heat exchanger in the embodiment of the present disclosure.

As shown in FIGS. 6 and 7, the fin 30 is a window fin and has wave crest portions 31 and wave trough portions 32. It is noted that in other embodiments, the fin may also be a fin without opening windows. The shape of the fin can be roughly corrugated, or it can be a profile. A cross section of the fin can be a sine wave or an approximate sine wave, or a sawtooth wave, as long as it meets the requirements, and its specific structure is not limited.

In the embodiment of the present disclosure, the fin 30 has a wave shape as a whole. An extension direction of the wave shape is a length direction of the heat exchange tube 20. The wave crest portions 31 and the wave trough portions 32 are arranged one by one at intervals. The fin 30 is arranged between two adjacent heat exchange tubes 20. The wave crest portions 31 are at least partially in contact with the heat exchange tube 21. The wave trough portions 32 are at least partially in contact with the heat exchange tube 22. The highest point of the wave crest portions 31 is a wave crest surface 311, and the lowest point of the wave trough portions 32 is a wave trough surface 321. The extension direction of the wave crest portions 31 and the wave trough portions 32 at intervals defining the length direction of the fin 30 (the X direction in the figure). A vertical direction between the plane of the wave crest surface 311 and the plane of the wave trough surface 321 defines the height direction of the fin (such as the Z direction in the figure). It can be seen that the length direction of the fin 30 is the same as the length direction of the heat exchange tube 20 (the X direction in the figure). A width direction of the fin 30 is the same as the width direction of the heat exchange tube 20 (the Y direction in the figure). The distance between the heat exchange tubes 20 is the height direction of the fin 30 (the Z direction in the figure).

As shown in FIG. 7, in an embodiment of the present disclosure, a part of the surface of the fin 30 is covered with the hygroscopic colloid 40. Specifically, the part of the surface is a location where the wave crest portions 31 and/or the wave trough portions 32 are covered with the hygroscopic colloid 40. The wave crest portions 31 and/or the wave trough portions 32 of the fin 30 are covered with the hygroscopic colloid 40, and the wave crest portions 31 or the wave trough portions 32 occupy 10% to 30% of the overall height of the fin 30. In other words, the wave crest portions 31 of the fin 30 extend from the wave crest surface 311 to the wave trough surface 321 to 10%-30% of the height of the fin 30. The wave crest portions 31 are covered with the hygroscopic colloid 40. The wave trough portions 32 of the fin 30 extend from the wave trough surface 321 to the wave crest surface 311 to 10% to 30% of the height of the fin 30. The wave trough portions 32 are covered with the hygroscopic colloid 40. It should be noted that the hygroscopic colloid 40 covered on the wave crest portions 31 and the wave trough portions 32 may be uniformly covered or non-uniformly covered. The covering thickness of the hygroscopic colloid is 0.07 mm to 1.0 mm, such as 0.1 mm, 0.15 mm, 0.20 mm, etc. It should be noted that the thickness of the above-mentioned hygroscopic colloid 40 is approximately the thickness. Due to the limitation of the process or other conditions, it may not achieve a completely uniform covering effect, or the covering is non-uniform, which is not limited here.

As shown in the embodiment shown in FIG. 6, part of the surface of the fin 30 is covered with the hygroscopic colloid 40. That is, the area A in FIG. 4 is covered with the hygroscopic colloid 40. The partial surface covering is covering from the end of the fin 30 along the length direction of the fin 30. The covering area occupies 5% to 15% of the total length of the fin 30. In other words, along the length direction of the fin 30 (i.e., the X direction in the figure), the total length of the fin 30 is L, which is covered from the end 33 of the first end of the fin 30. The length of the part of the fin covering the hygroscopic colloid occupies 5% to 15% of the total length L of the fin 30. For example, the length of the part of the fin covering the hygroscopic colloid occupies 10% of the total length of the fin 30. With such a structure, when the heat exchanger 30 is in a vertical state during actual use, the condensed water in the air is more likely to flow from the upper fin to the lower fin under the influence of force, and accumulate in the lower fin area. While avoiding the decrease in heat exchange efficiency caused by the overall covering, it can absorb moisture in the frost-prone portions to delay frost formation, thereby delaying the rate of heat exchange performance degradation of the heat exchanger. Wherein the vertical state means that the collecting pipe 10 is arranged approximately horizontally, that is, its center line is approximately horizontal, or there is an angle with the horizontal line but the angle is small. At this time, the heat exchange tube 20 is generally arranged in the vertical state.

Figure 9:
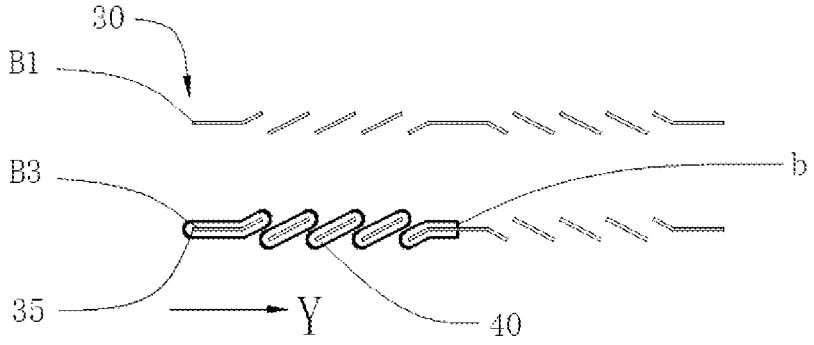
FIG. 9 is a schematic view of another fin before and after coating of the heat exchanger of the embodiment of the present disclosure.

As shown in FIG. 9, it is a schematic diagram of the comparison before and after the fin 30 is partially covered in accordance with another embodiment of the present disclosure. Part of the surface of the fin 30 is covered with the hygroscopic colloid 40. The partial surface covering is covering from the end of the fin 30 along the width direction of the fin 30 (i.e., the Y direction in the figure). The covering area occupies 30% to 50% of the total width of the fin 30. In other words, it is covered from the end 35 of the third end of the fin 30 along the width direction of the fin 30 (i.e., the Y direction in the figure). The width of the part of the fin covering the hygroscopic colloid 40 occupies 30% to 50% of the total width of the fin 30. For example, the width of the part of the fin 30 covering the hygroscopic colloid 40 occupies 40% of the total width of the fin 30. Wherein, B1 is a schematic view of the fin 30 not being covered, and B3 is a schematic diagram of partial covering along the width direction Y. The covering area occupies roughly 50% of the width of the fin 30. With such a structure, when the heat exchanger 100 is used in a horizontal state during actual use, the air inlet section is partially covered with the fin 30 to absorb water molecules in the air, which can avoid the decrease in heat exchange efficiency caused by the overall covering. The frost-prone portions (here mainly refers to the air inlet, that is, a first side of the heat exchanger 100, which is also knowns as a windward side of the heat exchanger 100) absorbs moisture and delays frosting, thereby delaying the time of the deterioration of the heat exchange performance of the heat exchanger. Wherein, the horizontal state means that the collecting pipe is arranged approximately horizontally. That is, the center line is roughly horizontal, or there is an angle with the horizontal line but the angle is small. At this time, the heat exchange tube is arranged in a generally vertical state, that is, the length direction of the heat exchange tube is roughly parallel to the X direction. Wherein, the horizontal state means that the collecting pipe is arranged substantially vertically. That is, the center line is approximately vertical, or there is an angle between the center line and the vertical line but the angle is small. At this time, the heat exchange tube is generally arranged in the horizontal state, that is, the length direction of the heat exchange tube is roughly parallel to the horizontal direction.

Figure 11:
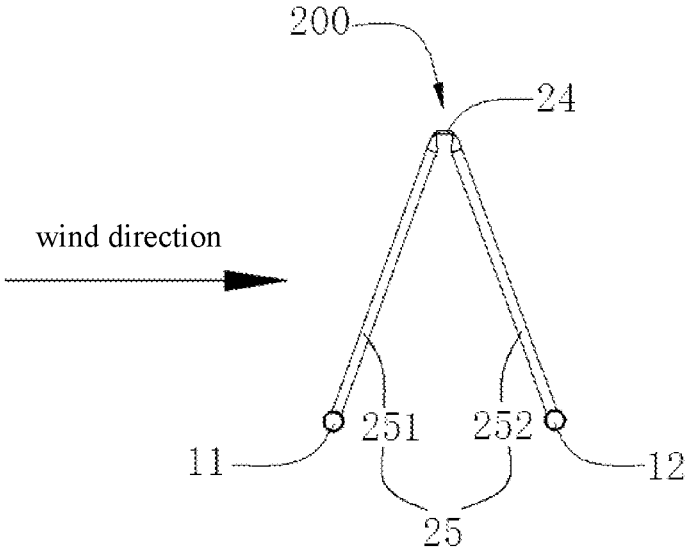
FIG. 11 is a schematic structural view of the heat exchanger according to another embodiment of the present disclosure.

FIG. 11 shows a heat exchanger 200 according to another embodiment of the present disclosure. The heat exchanger 200 also includes a collecting pipe 10, a plurality of heat exchange tubes 20 and fins 30. The difference from the heat exchanger 100 is that the plurality of heat exchange tubes 20 of the heat exchanger 200 have a bent portion 24. As shown in FIG. 11, the heat exchanger 200 has the bent portion 24. Of course, in some other embodiments, there may be more than two bent portions 24, which can be set according to actual needs. It is noted that, when the heat exchanger 200 and air undergo heat exchange more than one time, it is often referred to as a multi-layer heat exchanger or an N-layer heat exchanger in the industry.

As shown in FIG. 11 and combined with the foregoing embodiments, taking the heat exchanger 200 as an example, the heat exchanger 200 has a first collecting pipe 11, a second collecting pipe 12, the plurality of heat exchange tubes 20 and the fins 30. The first collecting pipe 11 and the second collecting pipe 12 are arranged substantially in parallel. One end of each heat exchange tube 20 is connected to the first collecting pipe 11 and the other end is connected to the second collecting pipe 12. The inner cavities of the first collecting pipe 11, the second collecting pipe 12, and the plurality of heat exchange tubes 20 are communicated with each other so as to form a refrigerant flow channel (not shown in the figure). Each heat exchange tube 20 has the bent portion 24 and a straight tube section 25. There is one bent portion 24. There are two straight tube sections 25, namely a first straight tube section 251 and a second straight tube section 252. The fins 30 are arranged between the adjacent heat exchange tubes 20. The length direction of the fin 30 is substantially the same as the length direction of the heat exchange tube 20. Specifically, the fins 30 are arranged between the first straight tube sections 251 of the adjacent heat exchange tubes 20 and/or between the second straight tube sections 252 of the adjacent heat exchange tubes 20. Part of the surface of the fin 30 is covered with the hygroscopic colloid 40. For example, the fin 30 arranged between the first straight tube sections 251 of the heat exchange tube 20 is covered with the hygroscopic colloid 40. At the same time, the fin 30 arranged between the second straight tube sections 252 of the heat exchange tube 20 is not covered with the hygroscopic colloid 40. Alternatively, the fin 30 arranged between the first straight tube sections 251 of the heat exchange tube 20 is not covered with the hygroscopic colloid 40. At the same time, the fins 30 arranged between the second straight tube sections 252 of the heat exchange tube 20 are covered with the hygroscopic colloid 40. The above structures are all covering parts of the fin 30 of the heat exchanger 200.

It should be noted that the FPI (FPI, namely Fin Per Inch, is a unit commonly used in the industry to express the density of fins) of the fins 30 arranged between the first straight tube sections 251 of the heat exchange tube 20 and the FPI of the fins 30 between the second straight tube sections 252 of the heat exchange tube 20 may be the same or different. As shown in FIG. 8, when the heat exchanger 200 is used as an outdoor heat exchanger in an actual heat pump system, the first straight tube sections 251 serve as a first side (that is, a windward side), and the second straight tube sections 252 serve as a second side (that is, a leeward side), the fins 30 between the first straight tube sections 251 of the heat exchange tube 20 are covered with the hygroscopic colloid 40, while the fins 30 between the second straight tube sections 252 are not covered with the hygroscopic colloid 40. At the same time, the FPI of the fins 30 arranged between the first straight tube sections 251 is smaller than the FPI of the fins 30 arranged between the second straight tube sections 252. In this way, the heat transfer efficiency of the fins 30 between the first straight tube sections 251 is reduced due to the hygroscopic colloid 40 being covered, and the FPI of the fins 30 between the second straight tube sections 252 on the leeward side is increased to be compensated.

Figure 12:
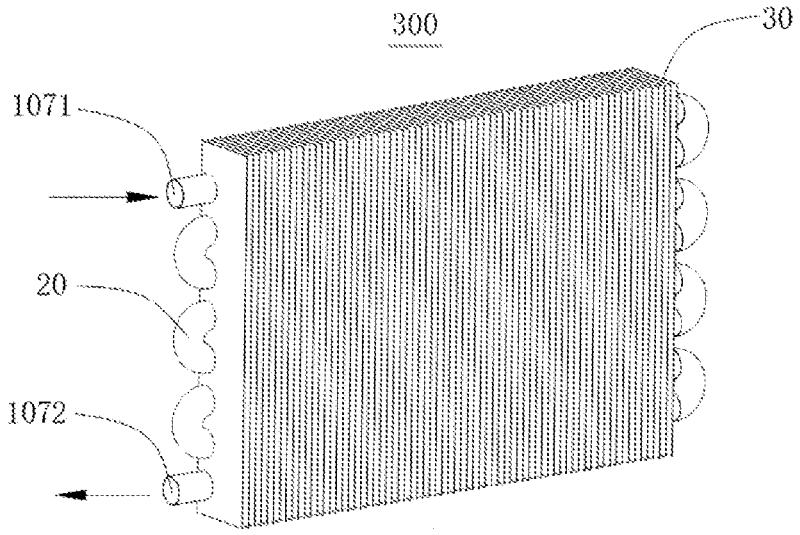
FIG. 12 is a schematic structural view of the heat exchanger according to another embodiment of the present disclosure.

As shown in FIG. 12, this is a heat exchanger 300 according to another embodiment of the present disclosure. The heat exchanger is a tube-fin heat exchanger. The heat exchanger 300 includes heat exchange tubes 20 and fins 30, wherein the heat exchange tubes 20 are usually copper tubes. The heat exchanger is also called a copper tube fin heat exchanger. When the heat exchanger 300 is used in a heat exchange system, the refrigerant can enter the heat exchanger 300 through the first inlet and outlet 1071, exchange heat with the heat exchange tubes 20, and then flow out of the heat exchanger from the outlet 1072. The heat exchanger, as shown by the arrow in the figure, is the flow direction of the refrigerant. It should be noted that the surface of the heat exchange tubes 20 and/or the fins 30 may be covered with the hygroscopic colloid 40. The covering may be a partial covering or a complete covering. The covering method is the same as the heat exchanger 100 and the heat exchanger 200 described above. The thickness of the covering is also the same as that described above, which will not be repeated here.

It should be noted that, in the embodiment of the present disclosure, a method of making a single-layer heat exchanger and a multi-layer heat exchanger having a partial surface of the fin covered with a hygroscopic colloid is disclosed.

Taking the single-layer heat exchanger 100 as an example, the collecting pipe 10, the plurality of heat exchange tubes 20 and the heat exchange fins 30 are assembled, and then spraying is performed. That is, the sol in which the hygroscopic colloid 40 is dissolved is coated on a partial area of the surface of the heat exchanger 100 by spraying. During the spraying process, it is necessary to control the spraying of the hygroscopic colloid 40 to the area of the fins to achieve partial coverage. For example, when covering the wave crest portions 31 and/or the wave trough portions 32 of the fins 30, it can be implemented in a manner similar to spraying a slogan. That is, a solid sheet material is used to block the middle area of the fins 30 to expose the area to be sprayed, and then spraying is performed. It is ensured that only the wave crest portions 31 and/or the wave trough portions 32 are covered, and the covering effect is shown in FIG. 7.

Figure 10:
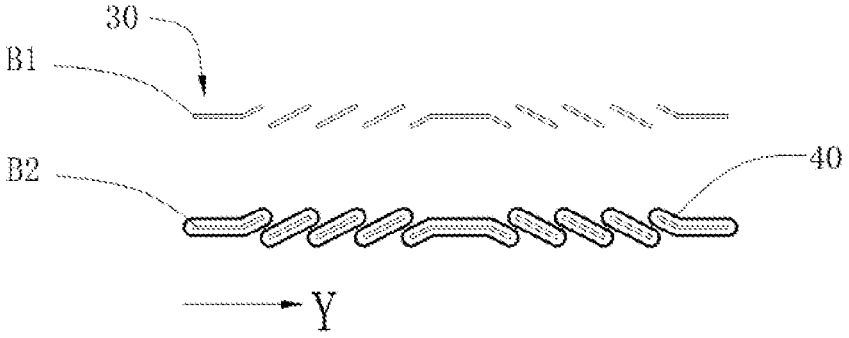
FIG. 10 is a schematic view of another fin before and after coating of the heat exchanger according to the embodiment of the present disclosure.

Taking the multi-layer heat exchanger 200 as an example, the collecting pipe 10, the plurality of heat exchange tubes 20 and the heat exchange fins 30 are assembled, and the first side area (that is, the windward side area) of the heat exchanger 200, the first straight tube sections 251 for example, is immersed in the sol in which the hygroscopic colloid 40 is dissolved, and then left to stand to dry. After the hygroscopic colloid 40 is tightly adsorbed on the fins 30 of the heat exchanger 200, the next step is performed as needed. The thickness of the hygroscopic colloid covering the surface of the heat exchanger 200 is 0.07 mm to 1.00 mm, such as 0.075 mm, 0.2 mm, 0.25 mm, etc., so that the moisture absorption can be guaranteed. The comparison diagrams of the fins before and after covering are shown in FIGS. 9 and 10, where B1 represents an uncoated fin, B2 represents a partial coating of the fin in the width direction, and B3 represents a complete coating in the width direction of the fin. The covering thickness b is controlled by the number of immersion into the container. That is to say, if it is necessary to increase the covering thickness, it can be left to dry after being immersed, and after the hygroscopic colloid is tightly adsorbed on the fin surface of the heat exchanger 200, the above steps are repeated again. It should be noted that the thickness of the above-mentioned hygroscopic colloid 40 is approximately the thickness. Due to the limitation of the process or other conditions, it may not achieve a completely uniform overlay effect, or the overlay is non-uniform, which is not limited here.

It is noted that the above spraying method may splash on the surface of the heat exchange tubes 20 during the spraying operation. The above immersion method will inevitably cover the hygroscopic colloid 40 on the surface of the heat exchange tubes 20 during the immersion operation, which is not limited here.

Figure 13:
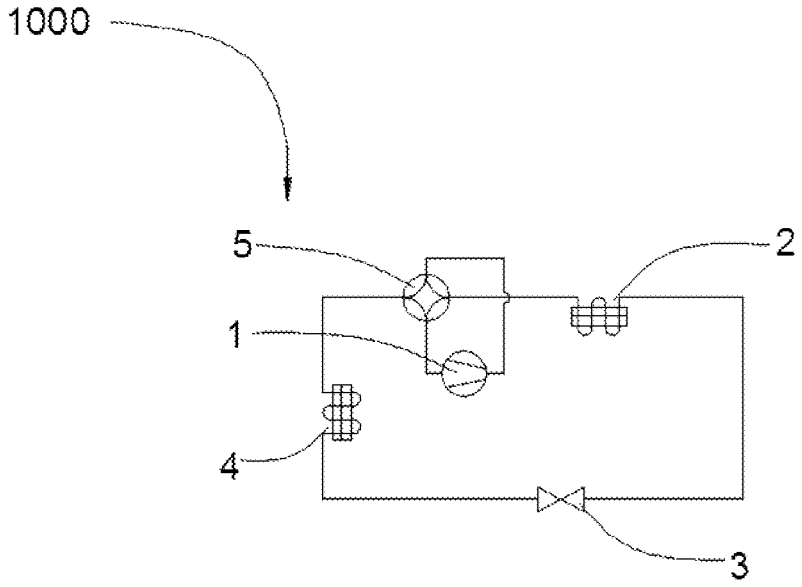
FIG. 13 is a schematic view of an exemplary heat exchange system of the present disclosure.

As shown in FIG. 13, it is a heat exchange system 1000 shown in an exemplary embodiment of the present disclosure. The heat exchange system 1000 at least includes a compressor 1, a first heat exchanger 2, a throttling device 3, a second heat exchanger 4, and a reversing device 5. Optionally, the compressor 1 of the heat exchange system 1000 may be a horizontal compressor or a vertical compressor. Optionally, the throttling device 3 may be an expansion valve. In addition, the throttling device 3 can also be other components that have the function of reducing pressure and regulating flow of the refrigerant. The present disclosure does not specifically limit the type of the throttling device, which can be selected according to the actual application environment, and will not be repeated here. It should be noted that in some systems, the reversing device 5 may not be provided. The heat exchangers 100, 200, and 300 described in the present disclosure can be used in the heat exchange system 1000 as the first heat exchanger 2 and/or the second heat exchanger 4. In the heat exchange system 1000, the compressor 1 compresses the refrigerant, the temperature of the compressed refrigerant increases, and then it enters the first heat exchanger 2. The heat is transferred to the outside through the heat exchange between the first heat exchanger 2 and the outside. After that, the refrigerant passing through the throttling device 3 becomes a liquid state or a gas-liquid two-phase state. At this time, the temperature of the refrigerant decreases, and then the lower temperature refrigerant flows to the second heat exchanger 4, and after the second heat exchanger 4 exchanges heat with the outside, it enters the compressor 1 again to realize the refrigerant circulation. When the second heat exchanger 4 is used as an outdoor heat exchanger for heat exchange with the air, referring to the above-mentioned embodiment, the heat exchanger is arranged according to actual needs.

The foregoing descriptions are only preferred embodiments of the present disclosure, and do not impose any formal restrictions on the present disclosure. Although the present disclosure has been disclosed as above in preferred embodiments, it is not intended to limit this application. Any person skilled in the art can make use of the technical content disclosed above without departing from the scope of the technical solution of the present disclosure. Changes or modifications are equivalent embodiments with equivalent changes. However, without departing from the content of the technical solution of the present disclosure, any simple amendments, equivalent changes and modifications made to the above embodiments based on the technical essence of the present disclosure still fall within the scope of the technical solution of the present disclosure.

What is claimed is:

1. A heat exchanger, comprising a first collecting pipe, a second collecting pipe, a plurality of heat exchange tubes and at least one fin;

the plurality of heat exchange tubes respectively connecting with the first collecting pipe and the second collecting pipe, the heat exchange tube comprising a pipe wall and a refrigerant flow channel for a refrigerant to circulate, the heat exchange tube comprising a first end and a second end along an extension direction of the heat exchange tube, the refrigerant flow channel extending from the first end to the second end along the extension direction of the heat exchange tube and extending through the heat exchange tube, and the refrigerant flow channel of the heat exchange tube communicating with an inner cavity of the first collecting pipe and an inner cavity of the second collecting pipe;

the fin being at least partially arranged between two adjacent heat exchange tubes;

wherein the heat exchanger further comprises a hygroscopic colloid adhered to at least part of an outer surface of the heat exchange tube and/or at least part of an outer surface of the fin;

wherein the outer surface of the fin comprises a covered area and a non-covered area, the covered area is covered with the hygroscopic colloid, and the non-covered area is not in contact with the hygroscopic colloid; and wherein the heat exchanger further comprises at least one of (a), (b) and (c):

(a) the hygroscopic colloid is covered along a width direction of the fin, and the covered area occupies 30% to 50% of a total width of the fin;

(b) the hygroscopic colloid is covered along a length direction of the fin, and the covered area occupies 5% to 15% of a total length of the fin;

(c) the hygroscopic colloid is covered along a height direction of the fin, and the covered area occupies 10% to 30% of a total height of the fin.

2. The heat exchanger according to claim 1, wherein the hygroscopic colloid is zinc oxide gel, and a solute of the zinc oxide gel is nano-sized zinc oxide.

3. The heat exchanger according to claim 1, wherein a pH value of the hygroscopic colloid is between 6 to 8.

4. The heat exchanger according to claim 1, wherein a covered thickness range of the hygroscopic colloid is 0.07 mm to 1 mm.

5. The heat exchanger according to claim 1, wherein the first collecting pipe and the second collecting pipe are arranged in parallel, each of the first collecting pipe and the second collecting pipe has a pipe wall and the inner cavity, and the pipe wall of each collecting pipe is provided with a plurality of openings which extend through the pipe wall of the collecting pipe;

wherein the plurality of the heat exchange tubes are arranged along an axial direction of the collecting pipe, the first ends of the heat exchange tubes are inserted into the first collecting pipe through the corresponding openings, respectively, and the second ends of the heat exchange tubes are inserted into the second collecting pipe through the corresponding openings, respectively.

6. The heat exchanger according to claim 5, wherein the fin extends along a length direction of the heat exchange tube.

7. A heat exchanger, comprising a first collecting pipe, a second collecting pipe, a plurality of heat exchange tubes and at least one fin;

the plurality of heat exchange tubes respectively connecting with the first collecting pipe and the second collecting pipe, the heat exchange tube comprising a pipe wall and a refrigerant flow channel for a refrigerant to circulate, the heat exchange tube comprising a first end and a second end along an extension direction of the heat exchange tube, the refrigerant flow channel extending from the first end to the second end along the extension direction of the heat exchange tube and extending through the heat exchange tube, and the refrigerant flow channel of the heat exchange tube communicating with an inner cavity of the first collecting pipe and an inner cavity of the second collecting pipe;

the fin being at least partially arranged between two adjacent heat exchange tubes;

wherein the heat exchanger further comprises a hygroscopic colloid adhered to at least part of an outer surface of the heat exchange tube and/or at least part of an outer surface of the fin;

wherein the fin extends along a length direction of the heat exchange tube, the outer surface of the fin comprises a covered area and a non-covered area, the covered area is covered with the hygroscopic colloid, and the non-covered area is not in contact with the hygroscopic colloid;

wherein the fin has a plurality of wave crest portions and a plurality of wave trough portions, the wave crest portions and the wave trough portions are alternately arranged along the length direction of the fin, the wave crest portion has a top end surface and the wave trough portion has a bottom end surface; the plurality of heat exchange tubes comprise a first heat exchange tube and a second heat exchange tube adjacent to the first heat exchange tube, the first heat exchange tube has a first top wall and a first bottom wall along a height direction of the heat exchange tube, the second heat exchange tube has a second top wall and a second bottom wall, the top end surface of the wave crest portion is in contact with the first bottom wall of the first heat exchange tube, the bottom end surface of the wave trough portion is in contact with the second top wall of the second heat exchange tube; the wave crest portion and/or the wave trough portion of the fin are covered with the hygroscopic colloid; at least a partial area of the wave crest portion and/or at least a partial area of the wave trough portion forms the covered area; and at least a partial area of the fin connected between the wave crest portion and the wave trough portion forms the non-covered area.

8. The heat exchanger according to claim 1, wherein the heat exchange tube includes at least one bent portion and two straight tube sections, the two straight tube sections include a first straight tube section located on a first side of the bent portion and a second straight tube section located on a second side of the bent portion, the first side is a windward side, and a surface of the first straight tube section is covered with the hygroscopic colloid.

9. The heat exchanger according to claim 1, wherein the heat exchange tube is a heat exchange copper tube, the fin is a sheet-shaped fin, the copper tube is inserted between the fins, and at least part of the fins is arranged between the copper tubes;

wherein at least part of the surface of the fin is covered with the hygroscopic colloid, and/or at least part of the surface of the heat exchange copper tube is covered with the hygroscopic colloid.

10. A method for making a heat exchanger, comprising:

providing a collecting pipe, a plurality of heat exchange tubes and at least one fin, inserting first ends and second ends of the plurality of heat exchange tubes into corresponding openings of the collecting pipe, respectively, assembling the fins between two adjacent heat exchange tubes, and performing a welding treatment after the assembly is completed; and providing a hygroscopic colloid, covering the hygroscopic colloid on the heat exchanger, and then performing a low temperature curing treatment;

wherein a covering method is at least one ways of spraying, brushing and dipping, and a temperature of the curing treatment is 40° C. to 70° C.

11. The method for making the heat exchanger according to claim 10, comprising following steps:

dissolving an appropriate amount of zinc acetate dihydrate in ethanolamine;

heating and stirring after isopropanol is added;

after the solution becomes transparent, adding salts that are weakly alkaline after hydrolysis, or adding weakly alkaline to adjust a pH value so as to obtain the hygroscopic colloid.

* * * * *